United States Patent [19]

Miraucourt et al.

[11] Patent Number: 5,017,088

[45] Date of Patent: May 21, 1991

[54] GAS TURBINE ENGINE COMPRESSOR CASING WITH INTERNAL DIAMETER CONTROL

[75] Inventors: Carmen Miraucourt, Brie Comte Robert; Gilles L. E. Delrieu, Montgeron, both of France

[73] Assignee: Societe Nationale d'Etude et de Construction de Moteurs d'Aviation"S.N.E.C.M.A.", Paris, France

[21] Appl. No.: 454,650

[22] Filed: Dec. 21, 1989

[30] Foreign Application Priority Data

Dec. 21, 1988 [FR] France ..... 88 16888

[51] Int. Cl.[5] ..... F01D 5/20

[52] U.S. Cl. ..... 415/173.2; 415/135; 403/28

[58] Field of Search ..... 415/214.1, 220, 108, 415/12, 134, 135, 173.1, 173.2, 173.3, 177, 126; 403/28

[56] References Cited

U.S. PATENT DOCUMENTS 4,844,688 7/1989 Clough et al. ..... 415/173.2

FOREIGN PATENT DOCUMENTS 2458676 1/1981 France .
2509373 1/1983 France .
2534982 4/1984 France .
2535795 5/1984 France .
2540560 8/1984 France .
2577282 8/1986 France .
2591674 6/1987 France .
0152907 7/1986 Japan ..... 415/173.2
0142808 6/1987 Japan ..... 415/173.2
1020900 2/1966 United Kingdom ..... 415/173.3
2024336 1/1980 United Kingdom ..... 415/173.2
2050527 1/1981 United Kingdom .
2169962 7/1986 United Kingdom .
2195715 4/1988 United Kingdom .

OTHER PUBLICATIONS

Patent Abstracts of Japan, vol. 7, No. 98 (M-210) (1243), Apr. 26, 1983, & JP-A-58 20 904, Feb. 7, 1983, K. Matsuda, "Seal Structure of Tip of Moving Blade for Gas Turbine".

Patent Abstracts of Japan, vol. 10, No. 354 (p-521) (2410), Nov. 28, 1986, & JP-A-61 152 907, Jul. 11, 1986, J. Kaneko, "Seal Part Gap Regulating Device for Turbine".

*Primary Examiner*—John T. Kwon
*Assistant Examiner*—Christopher M. Verdier
*Attorney, Agent, or Firm*—Oblon, Spivak, McClelland, Maier & Neustadt

[57] ABSTRACT

A compressor casing in a gas turbine engine includes an inner jacket formed by two half-shells connected by coupling flanges having cylindrical bellows fitted therebetween and arranged to expand and contract to control the inner diameter of the casing depending on the pressure within the bellows as provided by a supply of air taken from the downstream end of the compressor. The two half-shells are also interconnected by an additional flexible connection.

7 Claims, 3 Drawing Sheets

GAS TURBINE ENGINE COMPRESSOR CASING WITH INTERNAL DIAMETER CONTROL

BACKGROUND OF THE INVENTION

1. Field of the invention

The present invention relates to a gas turbine engine compressor casing fitted with means for controlling its inner diameter so as to ensure a minimum objective radial clearance between the rotor and the stator of the compressor.

2. Summary of the prior art

Various solutions have been proposed for maintaining a radial clearance which is as small as possible between the rotor and the associated stator of a gas turbine engine compressor, and in particular between the tips of the movable blades and the inner wall of a casing surrounding the array of the blades, in order to ensure satisfactory performance of the engine in providing a good output and a low specific fuel consumption, while at the same time maintaining sufficient clearance to prevent any damaging mechanical interference between the stationary and rotating parts, particularly during transient acceleration or deceleration conditions and in whatever order they may occur. For example, the adjustment of clearances during operation may be achieved by making use of thermal means, particularly hot or cold air flows having adjustable flow rates depending upon specific operating parameters of the engine or upon direct measurements, these air flows usually being used to control the expansions or contractions of mechanical parts. Examples of such solutions are disclosed in French Pat. Nos. 2 534 982, 2 535 795 and 2 540 560.

In other solutions, mechanical means are used to vary the diameter of casings or stationary parts situated facing the rotors or rotating parts of a gas turbine engine. Examples of such arrangements are disclosed in French Pat. Nos. 2 577 282 and 2 591 674.

However, these known solutions are not entirely satisfactory in all applications. The taking of air, often in relatively substantial amounts, required by implementing solutions using thermal means causes the engine performance to lose a not insignificant part of the contribution made by these arrangements. The mechanical means envisaged have the drawback of increasing the mass of the engine, which is particularly disadvantageous for aeronautical applications, and of requiring complicated assemblies. In particular, the implementation of the known solutions is found to be delicate and difficult to achieve in the application to gas turbine engine compressors with casings formed by two half-shells joined together by flanges.

SUMMARY OF THE INVENTION

Thus, it is an object of the invention to solve the problems described hereinabove without incurring the disadvantages of the known solutions, and in a manner which is advantageously applicable to gas turbine engine compressor casings comprising two half-shells.

To this end, according to the invention there is provided a gas turbine engine compressor casing including at least one radially inner jacket formed by two half-shells provided with coupling flanges, and control means for controlling the inner diameter of the inner jacket depending on the operating conditions of the engine, said control means comprising a plurality of cylindrical bellows secured between said coupling flanges of said two half-shells and connecting said flanges together, said bellows being deformable to vary the length thereof in response to variation of the pressure within said bellows, air bleed ducting communicating said bellows with the air under pressure at the downstream end of the compressor, and further connection means arranged between said two half-shells flexibly securing them together.

In one preferred embodiment said further connection means comprise a plurality of flexible C-shaped connection elements, each of said flexible connection elements straddling a respective one of said bellows and being secured at one end thereof to one of said two half-shells and at the other end thereof to the other of said half-shells.

In another preferred embodiment, in which the casing includes an outer jacket radially outwardly of said inner jacket, said further connection means comprise a number of pairs of lever arms, each of said arms having one end thereof pivotally connected to a respective one of said two half-shells in the vicinity of said coupling flange, and a second end thereof fixed to said outer jacket of the compressor casing by means of an elastic strap.

Other features and advantages of the invention will become apparent from the following description, with reference to the drawings, of two preferred embodiments of the invention.

DESCRIPTION OF THE PREFERRED EMBODIMENTS

Figure 1:
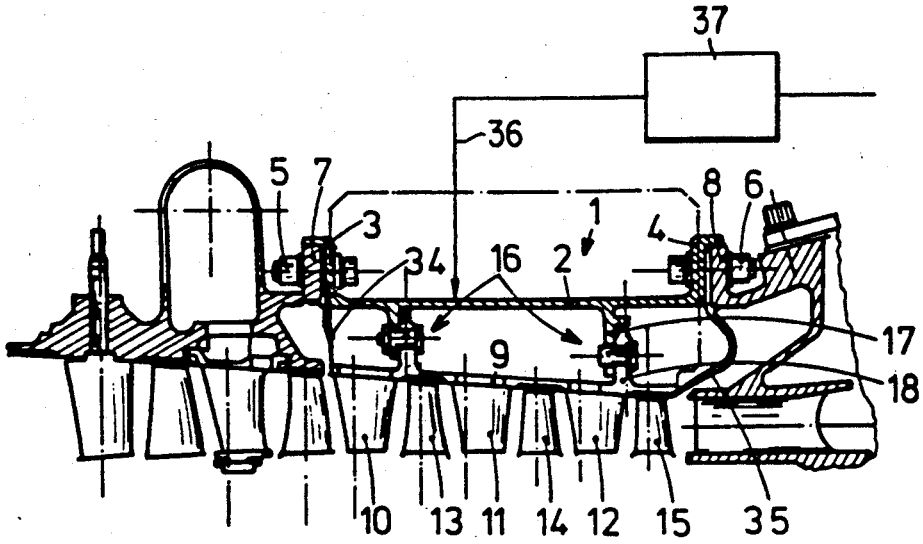
FIG. 1 is a diagrammatic sectional view of part of a first embodiment of a compressor casing in accordance with the invention, taken in a longitudinal plane passing through the axis of rotation of the compressor.
Figure 2:
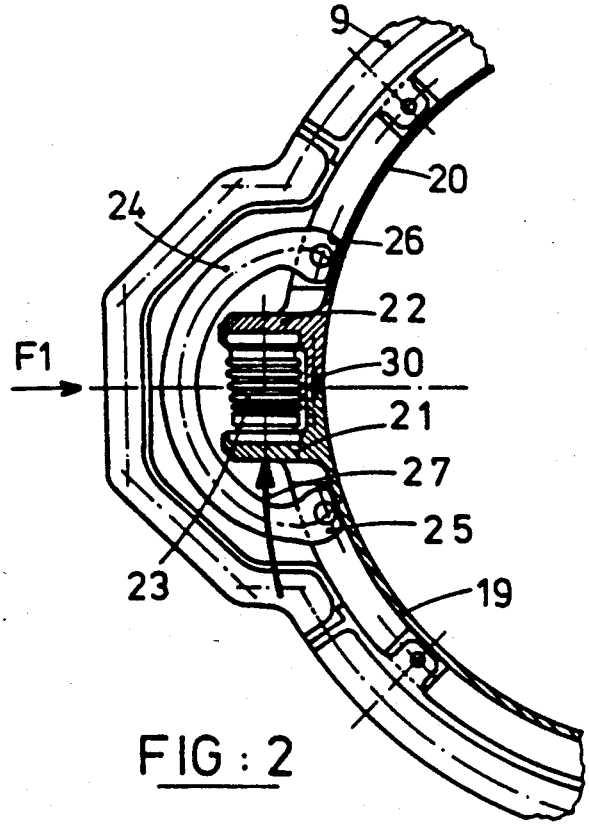
FIG. 2 is a diagrammatic part sectional view, on an enlarged scale, of a part of the compressor casing shown in FIG. 1, the view being taken in a radial plane and showing part of the means for controlling the inner diameter of the casing.
Figure 3:
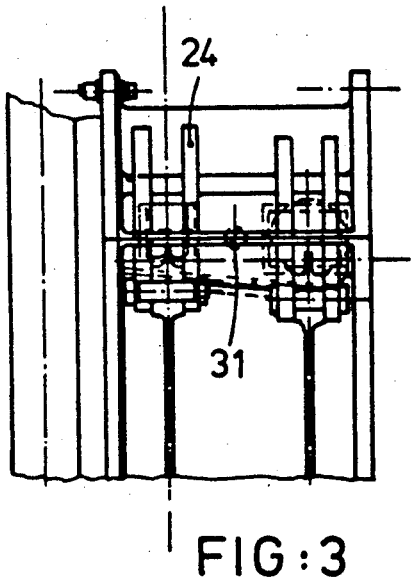
FIG. 3 is an elevational view along Fl in FIG. 2 showing a detail of the compressor casing.

The gas turbine engine Compressor casing 1 of the first embodiment shown in FIG. 1 comprises a radially outer jacket 2 having an outwardly directed radial flange 3,4 at each end connected in a known manner, such as by bolts 5,6, to the flange 7,8 of an adjacent casing. The casing 1 also comprises a radially inner jacket 9 which supports, in a manner which is known in the construction of axial compressors, a number (three in the present embodiment) of circular arrays of stationary blades forming stator stages 10,11,12 between which movable blade stages 13,14,15 of the compressor rotor are interposed. The outer and inner jackets 2 and 9 are joined together, in a manner which is also known, by sliding stud and slot connections 16 associated with radial lugs 17 and 18. These connections 16 are evenly distributed around the casing and, in the present embodiment, are arranged in two axially spaced sets of six.

The inner jacket 9 of the casing is formed by two half-shells 19 and 20 connected together in a manner providing means for controlling the inner diameter of the compressor casing 1 in accordance with the invention as shown in detail in FIGS. 2 to 5. Each half-shell 19,20 has a longitudinal flange 21,22 respectively along each edge, lying in a substantially horizontal plane in the assembled compressor. However, instead of being rigidly and directly connected together, the flanges 21 and 22 of the half-shells are slightly spaced and have bellows 23 disposed in the space therebetween such as shown in detail in FIG. 4. The bellows 23 is firmly fixed at each end to a respective one of the flanges 21 and 22 of the casing half-shells 19 and 20. In addition, a generally C-shaped flexible connecting element 24, straddling the bellows 23 and the flanges 21 and 22, is pivotally connected at its ends 25 and 26 to the half-shells 19 and 20 respectively. There are the same number of flexible connecting elements 24 as there are bellows 23, of which there are four in the present embodiment.

Figure 4:
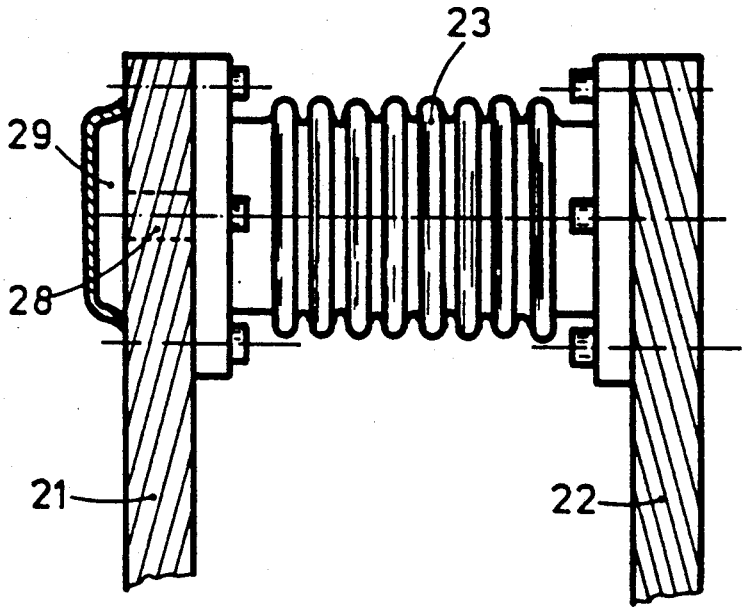
FIG. 4 is a view, on an enlarged scale, of a bellows element of the inner diameter control means of the compressor casing shown in FIG. 2.
Figure 6:
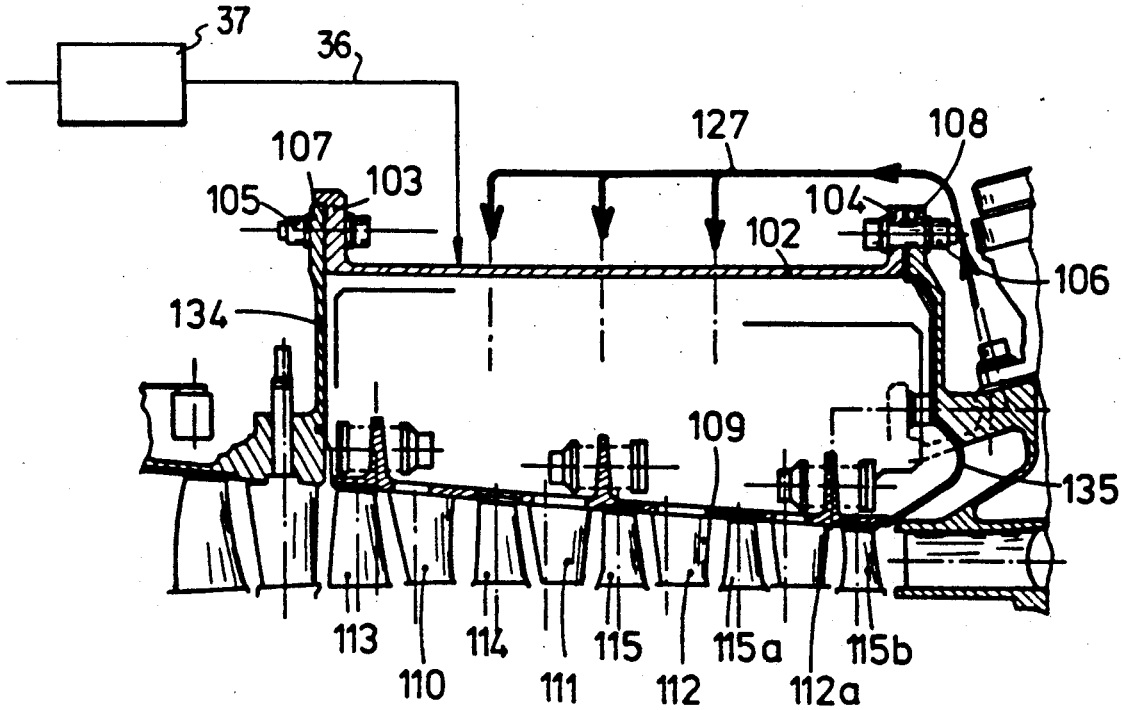
FIG. 6 is a view similar to that of FIG. 1, but of a second embodiment of a compressor casing in accordance with the invention.

Air supply ducting, symbolized at 27, feeds each bellows 23 with air taken from downstream of the compressor, the intake of air into the bellows 23 being effected through a passage 28 drilled in the flange 21 from a chamber 29 provided on the flange as shown in FIG. 4.

A seal between the two half-shells 19 and 20 is provided by longitudinal tongues 30 seated in grooves provided in the thickness of the half-shells where they are connected.

Figure 5:
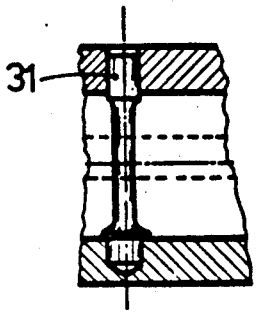
FIG. 5 is a fragmented view of a safety device forming part of the assembly arrangement of the two half-shells of the inner jacket of the compressor casing shown in FIG. 1.

Also, safety devices each including a rod 31 forming a spacer between the flanges 21 and 22 as shown in FIGS. 4 and 5 are arranged so as to ensure a minimum inner diameter of the compressor casing.

The operation of the means for controlling the inner diameter of the casing which has just been described is as follows. A pressure Pl is formed between the outer and inner jackets 2 and 9 by air taken, for example, from an air supply 36 of the casing 1, and a pressure P2 is created in each bellows 23 by the air supply 27. Any pressure increase in the flow at the exit of the compressor causes the control means to increase the inner diameter of the casing 1. The deformation and elongation of the bellows 23 exerts forces on each flange 21,22 of the inner jacket 9 of the casing. The two half-shells 19 and 20 are deformed solely in flexion and an increase of diameter without ovalization is obtained, the half-shells 19 and 20 being moved apart by the bellows 23 whereas the flexible elements 24 hold them back. Moreover, in the sliding connections 16 between the inner and outer jackets 9 and 2 of the casing, play is provided between the studs and the slots which allows non-radial movement of the studs in the slots.

Similarly, a fall in pressure in the flow at the exit of the compressor results in a reduction of the inner diameter of the casing towards its initial value. Thus, control of the inner diameter of the casing ensuring the objective clearance between the tips of the rotor blades and the corresponding diameter of the casing is achieved without consumption of power.

Several constructional variations may be introduced into the first embodiment of the invention which has been described above with reference to FIGS. 1 to 5. In particular, FIGS. 6 to 10 illustrate a second embodiment of the invention, and references increased by one hundred relative to those which were used in the description of the first embodiment will be used to denote parts or elements which are identical or operate in a manner similar to those of the first embodiment.

Thus, the gas turbine engine compressor casing 101 is composed of an outer jacket 102 having two flanges 103 and 104 at opposite ends joined to adjacent flanges 107 and 108 by bolts 105 and 106, and an inner jacket 109 formed by two half-shells 119 and 120 supporting the fixed blades of stator stages 110,111,112 and 112*a* between the movable blades of rotor stages 113,114,115, 115*a* and 115*b*. The two half-shells 119 and 120 also include longitudinal flanges 121 and 122 which are slightly spaced apart and interconnected by bellows 123 supplied with air taken downstream of the compressor by ducting 127. Also included are the sealing tongues 130 as well as the rod safety devices 131 indicated in FIGS. 8 and 9.

Figure 7:
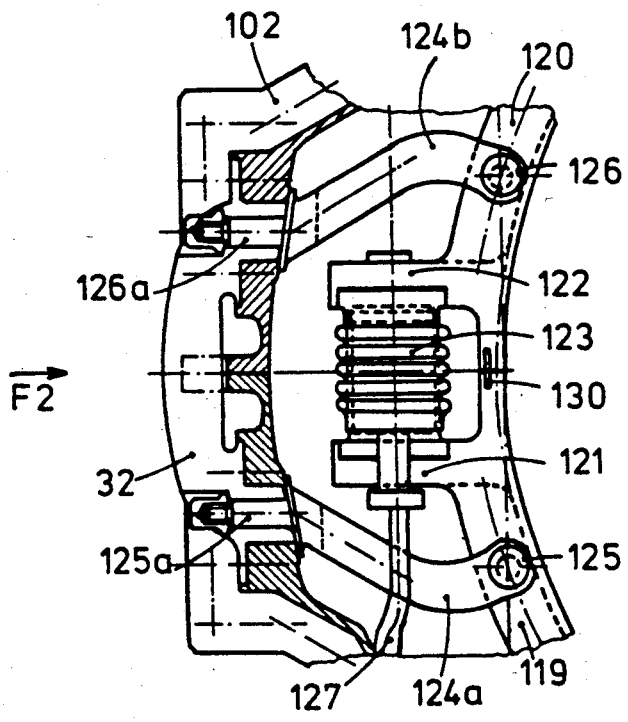
FIG. 7 is a view, similar to that of FIG. 2, showing part of the means for controlling the inner diameter of the casing in the second embodiment of FIG. 6.
Figure 9:
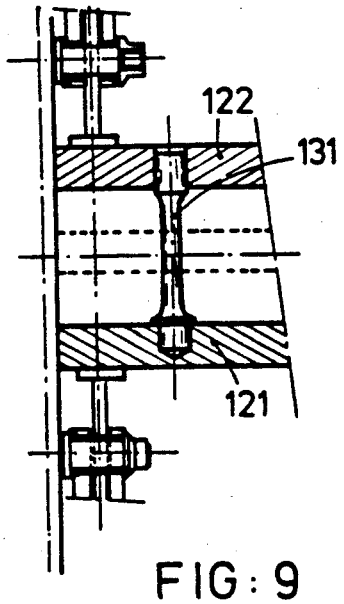
FIG. 9 is a fragmented view similar to that of FIG. 5, showing the safety device as used in the second embodiment.
Figure 8:
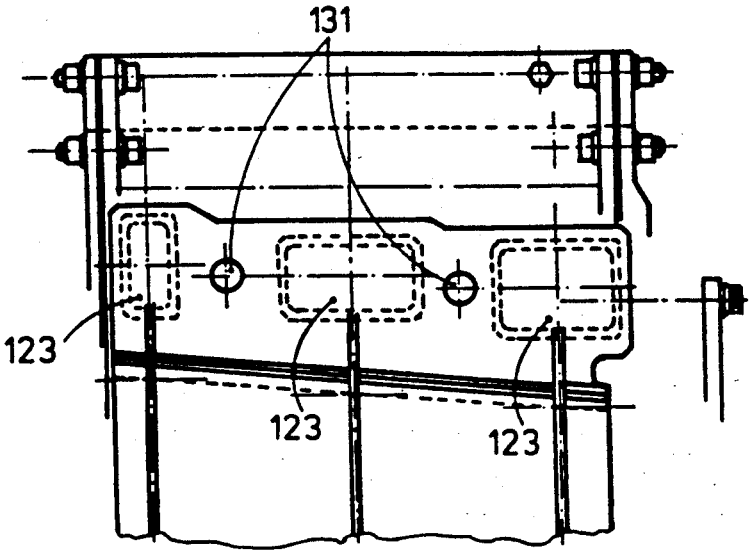
FIG. 8 is a view along F2 in FIG. 7, showing a detail of the compressor casing.

The variant incorporated in this second embodiment relates to the additional flexible connection means between the two flanges 121 and 122 of the two halfshells 119 and 120 of the inner jacket 109 of the compressor casing. As shown in FIGS. 7 and 8, the flexible connection means are formed in the region of each bellows 123 by two lever arms 124*a* and 124*b*. Each lever arm 124*a*,124*b* has one of its ends 125,126 pivotally connected to one of the half-shells 119,120 respectively and its other end 125*a*,126*a* secured to the outer jacket 102 of the casing by means of an elastic strap 32. In this second embodiment shown in FIGS. 6 to 10, there are six bellows 123 and six associated pairs of lever-arms 124*a* and 124*b*.

The operation of the means for controlling the inner diameter of the casing in this second embodiment is the same as previously described for the first embodiment with reference to FIGS. 1 to 5.

Figure 10:
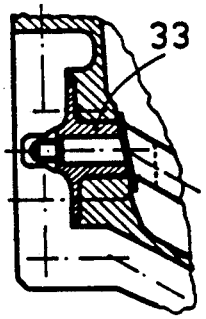
FIG. 10 is a fragmented sectional view of a device used for the installation of the inner diameter control means of the compressor casing shown in FIG. 7.

Another feature of the second embodiment relates to the assembly of the unit. As illustrated in FIG. 10, elements 33 are used to hold the lever arms 124*a*,124*b* in position during the positioning of the elastic strap 32, these elements 33 subsequently being removed.

In both embodiments, the means for controlling the inner diameter of the compressor casing may be combined with further mechanisms. For example, as shown in FIG. 1 for the first embodiment and in FIG. 6 for the second embodiment, fluid-tight walls, respectively 34,35 and 134,135, are arranged at opposite ends of the casing between the inner jacket 9,109 and the outer jacket 2,102, thus forming a sealed enclosure between the two jackets. The air pressure Pl prevailing in this enclosure can also be controlled, for example by providing a valve 37 in the air bleed effected upstream of the casing for supplying the enclosure, the control of this valve 37 (not shown) being by a device controlled by an operating parameter of the engine or by a measurement of the actual clearance between the rotor and stator during operations of the compressor.

We claim:

1. In a compressor of a gas turbine engine, a casing including at least one radially inner jacket formed by two half-shells provided with coupling flanges, and control means for controlling the inner diameter of the inner jacket depending on the operating conditions of the engine, said control means comprising a plurality of cylindrical bellows secured between said coupling flanges of said two half-shells and connecting said flanges together, said bellows being deformable to vary the length thereof in response to variation of the pressure within said bellows, air bleed ducting communicating said bellows with the air under pressure at the downstream end of the compressor, and further connection means arranged between said two half-shells flexibly securing them together.

2. A compressor casing according to claim 1, wherein said further connection means comprise a plurality of flexible C-shaped connection elements, each of said flexible connection elements straddling a respective one of said bellows and being secured at one end thereof to one of said two half-shells and at the other end thereof to the other of said half-shells.

3. A compressor casing according to claim 2, wherein there are four of each of said bellows and said flexible connection elements.

4. A compressor casing according to claim 1, wherein said casing includes an outer jacket radially outwardly of said inner jacket and said further connection means comprise a number of pairs of lever arms, each of said arms having one end thereof pivotally connected to a respective one of said two half-shells in the vicinity of said coupling flange, and a second end thereof fixed to said outer jacket of the compressor casing by means of an elastic strap.

5. A compressor casing according to claim 4, wherein there are six of each of said bellows and said pairs of lever arms.

6. A compressor casing according to claim 1, including a safety device comprising at least two rods forming spacer struts between said two half-shells for maintaining a minimum inner diameter of said casing.

7. A compressor casing according to claim 1, wherein said casing includes an outer jacket radially outwardly of said inner jacket and walls at each end of said casing whereby a sealed enclosure is formed between said radially inner and outer jackets of said casing, and a valve for controlling the pressure of air within said enclosure.

* * * * *

UNITED STATES PATENT AND TRADEMARK OFFICE

CERTIFICATE OF CORRECTION

PATENT NO. : 5,017,088

DATED : May 21, 1991

INVENTOR(S) : Carmen Miraucourt, Gilles L. E. Delrieu

It is certified that error appears in the above-identified patent and that said Letters Patent is hereby corrected as shown below:

Column 3, line 54, after "36" insert --upstream--.

Column 4, line 67, delete "(not shown)".

Signed and Sealed this

Twenty-second Day of June, 1993

*Attest:*

Michael K. Kirk

MICHAEL K. KIRK

*Attesting Officer*

*Acting Commissioner of Patents and Trademarks*